US005472146A

United States Patent [19]

Doppstadt

[11] Patent Number: 5,472,146

[45] Date of Patent: Dec. 5, 1995

[54] INFEED MEANS FOR COMMINUTING MACHINE

[76] Inventor: Werner Doppstadt, Vossnacker Strasse 67, 42555 Velbert, Germany

[21] Appl. No.: 217,372

[22] Filed: Mar. 24, 1994

[30] Foreign Application Priority Data

Apr. 20, 1993 [DE] Germany ..... 9305854 U

[51] Int. Cl.[6] ..... B02C 23/00; B02C 23/02; B02C 13/26

[52] U.S. Cl. ..... 241/35; 241/160; 241/186.35; 241/189.1; 241/101.76

[58] Field of Search ..... 241/34, 35, 160, 241/186.35, 187, 189.1, 223, 239, 241, 242, 285.2, 285.3, 101.76

[56] References Cited

U.S. PATENT DOCUMENTS

| | | | |
|---|---|---|---|
| 1,307,761 | 6/1919 | Shelton | 241/186.35 X |
| 2,927,740 | 3/1960 | Beck | 241/35 X |
| 4,226,372 | 10/1980 | Wigand | 241/160 X |
| 4,625,924 | 12/1986 | Killinger | 241/186.35 |
| 4,852,816 | 8/1989 | Doppstadt . | |
| 4,874,024 | 10/1989 | Arasmith | 241/35 X |
| 4,927,088 | 5/1990 | Brewer | 241/223 |

FOREIGN PATENT DOCUMENTS

| | | |
|---|---|---|
| 212194 | 7/1986 | European Pat. Off. . |
| 2902257 | 7/1980 | Germany . |

OTHER PUBLICATIONS

Literature for FLUDEX Fluid Couplings manufactured by A. Friedr. Flender AG, Germany.

*Doppstadt* Brochure for AK 330 Shredder.

*Primary Examiner*—Timothy V. Eley

*Attorney, Agent, or Firm*—Collard & Roe

[57] ABSTRACT

The comminuting machine includes a housing provided with a rotary impact mechanism. Infeed apparatus including a conveyor and a revolving intake roll act upon the infed material for conveying the same to the rotary impact mechanism. An entrance gap is defined between an impact ledge and the rotary impact mechanism and provides initial comminution. The impact ledge is mounted at a carrier which also supports a pressure fluid operated motor for driving the infeed apparatus. The entrance gap is followed by an impact plate which cooperates with the rotary impact mechanism in further disintegrating the infed material.

18 Claims, 5 Drawing Sheets

INFEED MEANS FOR COMMINUTING MACHINE

CROSS TO RELATED APPLICATION

This application is related to my copending U.S. patent applications Ser. No 08/215,326, filed Mar. 21, 1994, entitled "Mobile Material Processing Machine With Tandem Axle"; Ser. No. 08/215,523, filed Mar. 22, 1994, entitled "Arcuate Impact Plate and Comminuting Machine With Arcuate Impact Plate"; Ser. No 08/217,377, filed Mar. 24, 1994, entitled "Comminuting Machine with Comb-like Further Comminuting Structure"; Ser. No 08/215,521, filed Mar. 22, 1994, entitled "Comminuting Machine with Comminuting Grates"; and Ser. No. 08/217,388, filed Mar. 24, 1994, and entitled "Comminuting Machine with Comminution Cover Plate".

BACKGROUND OF THE INVENTION

The present invention relates to a new and improved construction of a comminuting machine.

In its more particular aspects, the present invention specifically relates to a new and improved construction of a comminuting machine for comminuting waste material which may be intended to be composted. Generally, such machines are mounted at a mobile support frame and comprise a housing in the form of a container for receiving the material to be comminuted. A conveyor is disposed in the housing or container for conveying the infed material to a rotary impact mechanism. The rotary impact mechanism cooperates with an impact plate in a comminuting section which precedes a discharge opening of the housing or container for discharging the comminuted material under the action of the rotary impact mechanism. The impact plate may be followed by further comminuting means through which the comminuted material is discharged with further comminution. The comminuted material may be deposited in stacks or pits for composting.

A comminuting machine or composting equipment such as known, for example, from U.S. Pat. No. 4,852,816, granted on Aug. 1, 1989 to the applicant of the instant application, is constructed for comminuting organic or wood waste originating in forestry, municipality or building operations. A trough-shaped container receives the material to be comminuted, for example, by means of a shovel loader. Infeed means are provided in the form of an infeed conveyor which is located above the bottom of the container and feeds the material to a rotary impact mechanism. The rotary impact mechanism drives the infed material through an entrance gap defined between an impact ledge and rotating flails of the rotary impact mechanism. The impact ledge is followed by retainer claws which extend between adjacent ones of the rotating flails for comminuting the material which has been forced through the entrance gap. An impact plate follows the retainer claws and has teeth protruding toward the rotating flails and cooperating therewith for further comminuting the material prior to its discharge through a discharge opening from a rear part of the container.

In a further development (Doppstadt shredder, type AK 330) of the aforementioned comminuting machine, the infeed means or apparatus include an infeed conveyor in the form of a scraper conveyor acting from below on the infed material and a revolving heavy-weight intake roll which bears upon the infed material for conveying the same to the entrance gap. The entrance gap is defined by an impact ledge and the rotary impact mechanism. The entrance gap is followed by an impact plate containing two plate sections. The two plate sections are arranged at an angle with respect to each other so that the impact plate extends along an upper part of the cylindrical action area of the rotating flails. Teeth protrude from the impact plate toward the rotating flails and are arranged in parallel rows transverse with respect to the rotational direction of the rotating flails, the rows of teeth being transversely offset from each other. There is thus defined a throughpass gap through which the incoming material is forced under the action of the rotating flails and subjected to comminuting action. The impact plate is followed by a discharge opening and, if desired, further comminuting means. A prime mover like a diesel engine drives the rotary impact mechanism through an overload coupling such as a fluid or hydrodynamic coupling. Such coupling mainly serves to dampen rapid transient variations in the rotational speed of the rotary impact mechanism in order to prevent such variations from affecting the prime mover. Also driven by the prime mover is a main hydraulic pump like an axial piston pump which supplies pressure fluid to pressure fluid operated components of the comminuting machine such as infeed drive means driving the infeed means or apparatus. Overload control means are additionally provided for controlling the conveying rate of the infeed means as a function of the rotational speed of the rotary impact mechanism, particularly by decelerating or eventually shutting off the infeed drive means in the presence of an excessive load at the rotary impact mechanism.

In both of the aforementioned comminuting machines the impact plate as well as the further comminuting means, if present, are pivotably supported so as to pivot away from the rotating flails in the event that the infed material contains pieces of material which do not disintegrate under the action of the rotating flails in cooperation with the impact plate. The rotary impact mechanism and the impact plate are thus prevented from damage by pieces of non-disintegratable material.

Furthermore, both of the aforementioned comminuting machines are mobile machines in which the container is mounted at a support frame on wheels. Such wheel support can be provided by supporting the comminuting machine on a truck such as known from European Patent No. 0,212,194, the grant of which to the applicant of the instant application was published on Oct. 11, 1987; in such construction the engine of the truck also serves to drive the comminuting machine. The wheel-supported support frame may also carry a power unit for operating the comminuting machine. The power unit is placed at a support frame end remote from the rotary impact mechanism and outside of the trough-shaped container below a protective shield extending therefrom. As described in the aforementioned U.S. patent, such comminuting machine may be displaced at the given working location by means of the shovel loader used for charging the comminuting machine. The support frame may also be supported at a tandem axle. Pressure fluid operated drive means acting upon the front wheels of the tandem axle may be provided for displacing the comminuting machine at the working location (Doppstadt shredder AK 330). Remote control means may be used for controlling the operation of the comminuting machine including the pressure fluid operated drive means. While the machine can be operated in this manner independent of a truck, travel to a different working location requires connection to a towing vehicle like a tractor or truck.

A stationary comminuting machine such as known, for example from German Published Patent Application No.

2,902,257 published on Jul. 31, 1980 is intended for comminuting particularly confidential files but also waste materials of any kind including waste wood. Infeed means like infeed rolls feed the material to an inlet gap and into the interior of a drum-like housing. Parts of the infed material protrude through the inlet gap and are severed or chopped off by a rotary impact mechanism. Following the inlet gap, the drum-like housing accommodates a basically segment-shaped impact body defining a throughpass gap in cooperation with the rotary impact mechanism. The throughpass gap narrows from the inlet gap to an outlet and extends around the upper half of the rotary impact mechanism. The impact body is mounted at the drum-like housing by means of bolts permitting adjustment of the impact body in radial direction relative to the rotary impact mechanism. At its rear end, as viewed in the rotational direction of the rotary impact mechanism, the impact body bears upon a stop. The impact body is provided on its inner side with, for example, a saw-tooth profile which extends parallel to the axis of the rotary impact mechanism. The impact body is followed, in the rotational direction of the rotary impact mechanism, by grate means which extends around the lower half of the rotary impact mechanism and defines a throughpass gap which narrows in the rotational direction.

Contrary to the first mentioned mobile waste comminuting machines, the last mentioned stationary comminuting machine is not provided with any means permitting the impact body and other structures which cooperate with the rotating hammers, to yield in the presence of non-disintegratable material.

Regarding the aforementioned mobile waste comminuting machines, it has been found that the impact ledge suffers rapid wear and thus needs relatively frequent replacement. Also, there exist problems regarding the accommodation of the pressure fluid operated drive motor for driving the infeed means or apparatus.

SUMMARY OF THE INVENTION

Therefore, with the foregoing in mind, it is a primary object of the present invention to provide a new and improved construction of a comminuting machine which is not afflicted with the drawbacks and limitations of the prior art constructions heretofore discussed.

Another and more specific object of the invention is directed to the provision of a new and improved construction of a comminuting machine in which the useful service life of a given impact ledge is increased.

It is an important object of the invention to provide a new and improved construction of a comminuting machine in which the used impact ledge can be readily exchanged for a new impact ledge, if desired.

A further significant object of the present invention resides in providing a new and improved construction of a comminuting machine in which the pressure fluid operated motor for driving the infeed means is accommodated in a place saving manner.

Particularly, a still further important object of the present invention is directed to the provision of a new and improved construction of a comminuting machine in which the pressure fluid operated motor for driving the infeed means is placed in a manner permitting ready connection to the pressure fluid pump as well as to the infeed means driven by the pressure fluid operated motor.

Now in order to implement these and still further objects of the invention, which will become more readily apparent as the description proceeds, the comminuting machine of the present development is manifested by the features that, among other things, there is provided a common carrier or support for the impact ledge and the pressure fluid operated drive motor for driving the infeed means, the carrier being affixed to opposite side walls of the housing or container. The impact ledge is exchangeably mounted at the carrier and protrudes therefrom toward the rotary impact mechanism in order to define the entrance gap.

Preferably, the carrier is formed by a hollow carrier having a surface at which the impact ledge is releasably secured. The impact ledge has a width greater than the width of the associated surface of the hollow carrier and provided with two spaced rows of releasable fastening means for securing the impact ledge at the associated surface of the hollow carrier. As a result, the impact ledge, when worn along one edge thereof, can be disengaged from the hollow carrier, turned around and re-engaged thereto. As a result, the useful service life of a given impact ledge is increased at least by a factor of two.

Due to the use of a hollow carrier for mounting the impact ledge, space is obtained for accommodating the pressure fluid operated drive motor for driving the infeed means. This drive motor is still located such that it is readily accessible and connected to a common chain drive for driving the conveyor as well as the intake roll of the infeed means.

A further advantage achieved by this arrangement resides in the fact that the infeed drive means are placed in direct driving connection to drive means for driving the rotary impact mechanism and that the overload control means operate on both the conveyor and the intake roll of the infeed means.

BRIEF DESCRIPTION OF THE DRAWINGS

The invention will be better understood and objects other than those set forth above, will become apparent when consideration is given to the following detailed description thereof. Such description makes reference to the annexed drawings wherein the same or analogous components are designated by the same reference characters and wherein.

BRIEF DESCRIPTION OF THE PREFERRED EMBODIMENTS

Figure 1:
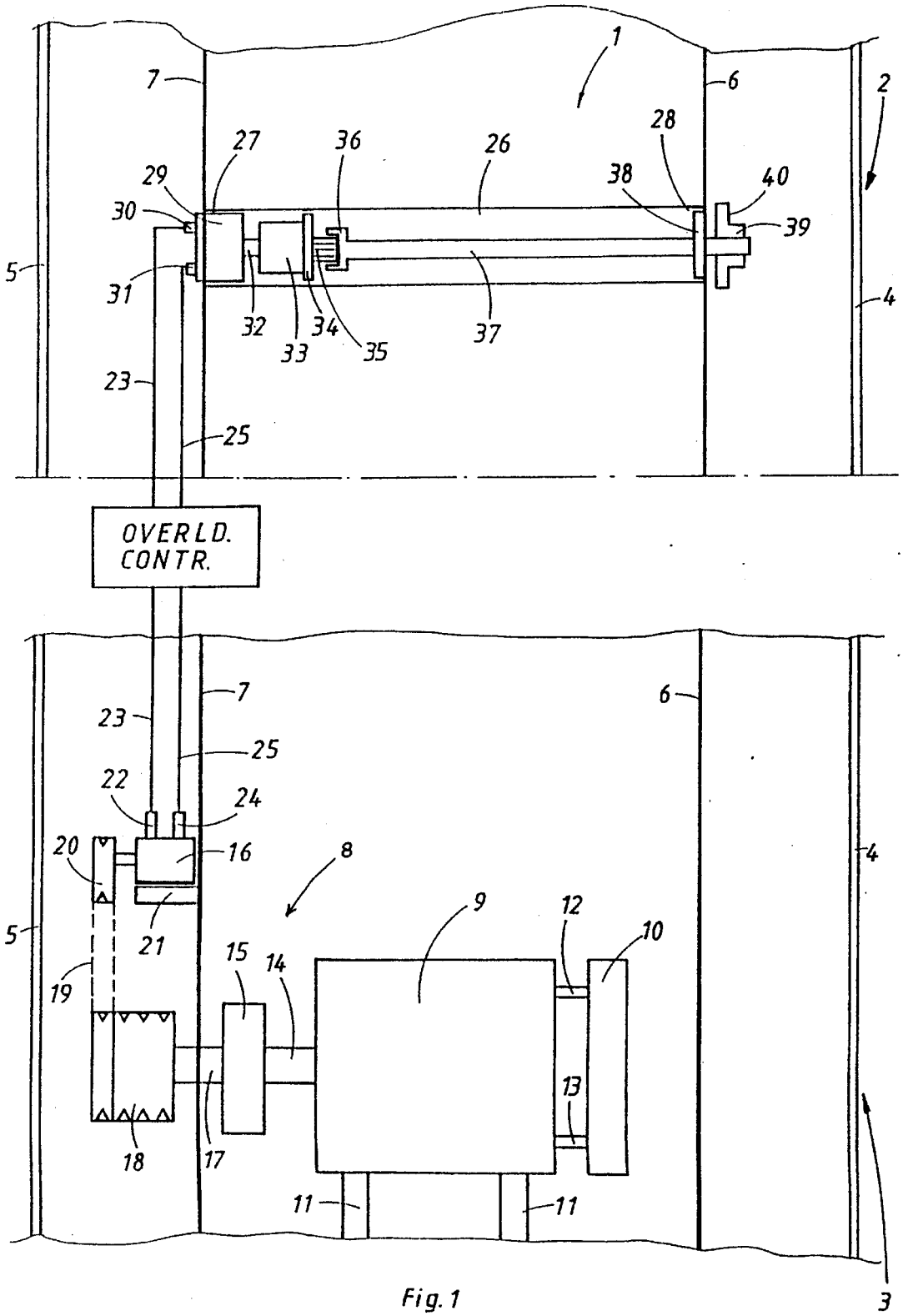
FIG. 1 is a schematic view of a power unit and its connection with the infeed drive means in an exemplary embodiment of the inventive comminuting machine.

Describing now the drawings, it is to be understood that only enough of the construction of the comminuting machine has been shown as needed for those skilled in the art to readily understand the underlying principles and concepts of the present development, while simplifying the showing of the drawing. Generally, the inventive comminuting machine includes a stationary or mobile housing which houses a rotary impact mechanism and receives the material to be comminuted, namely domestic or industrial waste. While the illustrated exemplary embodiment is concerned with a mobile machine of this type which is supported at a wheel-supported support frame which also carries the drive means for operating the machine, it will be understood that the inventive construction can also be realized in connection with a truck supported mobile comminuting machine. Also, the illustrated exemplary embodiment may be provided with independent drive means as disclosed in the first initially cross-referenced U.S. patent application. Naturally, the inventive construction is not limited to the illustrated example of a waste comminuting machine but can also be realized in connection with comminuting machines for processing other kinds of material and based on the same basic constructional principles.

Turning attention now to FIG. 1 of the drawings, there has been shown in a schematic manner the drive means present in the inventive comminuting machine 1. Specifically, the inventive comminuting machine 1 includes a trough-shaped container having a rear part 2 and opposite side walls 4 and 5. The interior of the container 1 receives the material to be comminuted by means of, for example, a shovel loader and is separated from the side walls 4 and 5 by partitions 6 and 7. The intermediate space defined between the side walls 4 and 5 and the respective partitions 6 and 7 serves for accommodating various other elements of the comminuting machine 1, for example, drive belts etc.

A power unit 8 is placed on the support frame (not shown) at a front part 3 of the comminuting machine 1 outside of the trough-shaped container from which a protective shield (not shown) extends and covers the power unit 8 of the comminuting machine 1 as known from the initially mentioned '816 U.S. patent. This power unit 8 basically contains a prime mover 9 like, for example, a diesel engine with associated cooler 10 resting on supports 11. The prime mover also may be an electric motor when the comminuting machine 1 is exclusively operated at locations where electric power is available. Coolant lines 12 and 13 interconnect the prime mover or diesel engine 9 and the cooler 10. An output shaft 14 of the prime mover 9 is drivingly connected to a fluid or hydrodynamic coupling 15. Such fluid coupling is available, for instance, from A. Friedrich Flender AG, Alfred-Flender-Sraβe 77, 46395 Bocholt, Germany, under the designation "FLUDEX FGD". The coupling elements on the input and output side are not mechanically connected and torque is transmitted therein by rotating fluid like oil under the action of radial blades. The coupling 15 mainly serves to dampen rapid transient variations in the rotational speed of the rotary impact mechanism due to, for example, sudden transient overloads and thereby prevents the same from becoming effective at the prime mover 9.

Figure 4:
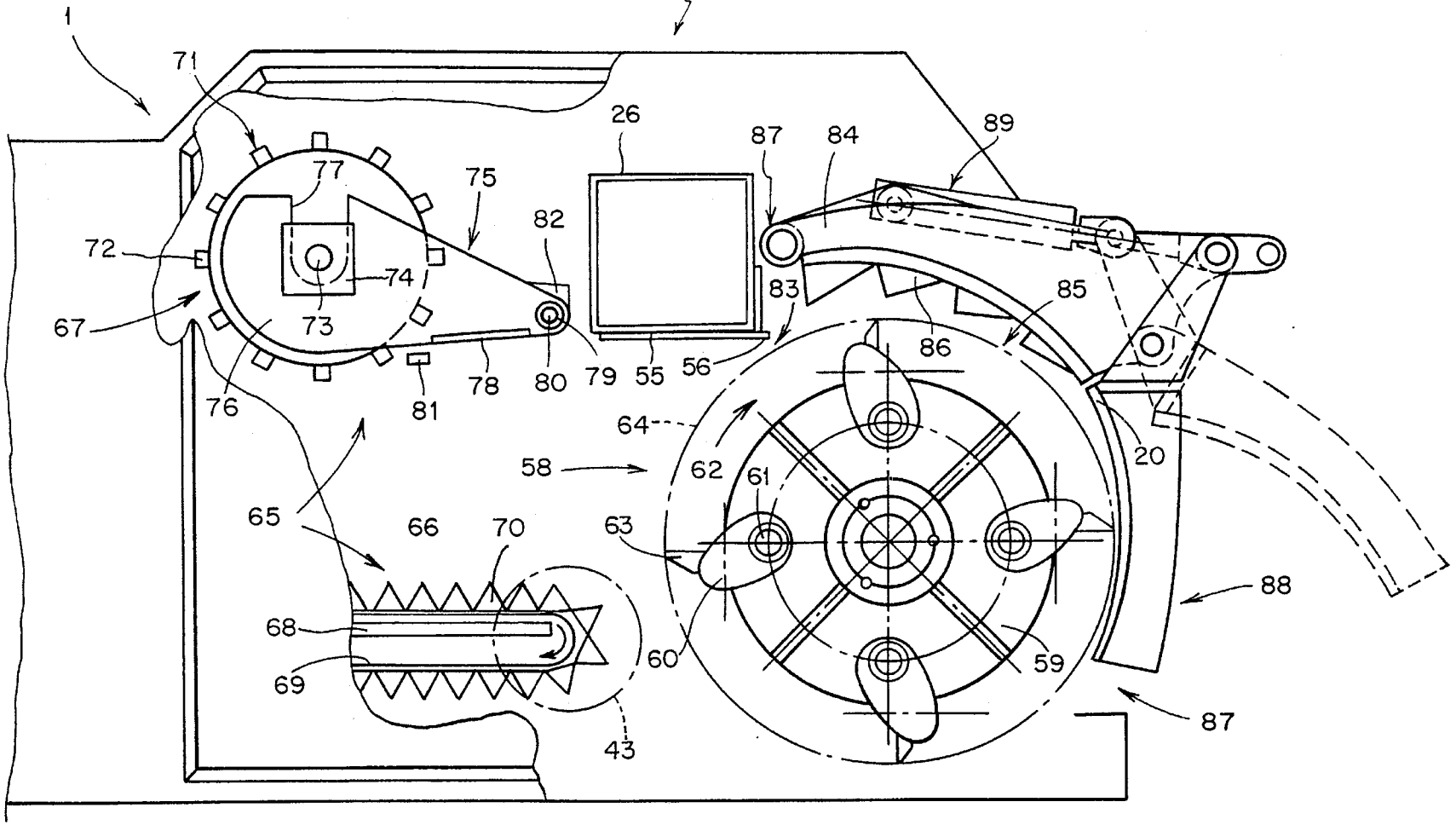
FIG. 4 is a schematic side view of the container rear part in the absence of the side wall as shown in FIG. 2.

A pressure fluid main pump 16 such as, for example, an axial piston pump is connected to an output shaft 17 of the fluid coupling 15 through a transmission 18. In the illustrated exemplary embodiment, the transmission 18 is in the form of a belt transmission and is part of multiple V-belt drive means for driving the rotary impact mechanism 58 as shown in FIG. 4. A belt 19 provides a driving connection between the transmission 18 and a drive disc 20 of the pressure fluid main pump 16 which is mounted at a mounting plate 21 affixed to, for instance, the outer side of the partition 7. The pressure fluid main pump 16 has an output 22 connected to a feed line 23 and an input connected to a return line 25. The pressure fluid pump 16 serves for supplying pressure fluid to various pressure fluid operated components of the comminuting machine 1 including infeed drive means 29,37,41 to be described hereinbelow. The pressure fluid pump 16 thus is seen to be in driving connection with the transmission 18 which, in turn, is drivingly connected to the rotary impact mechanism 58. As a result, there is achieved the beneficial effect that the operation of the pressure fluid pump 16 directly varies as a function of the rotational speed of the rotary impact mechanism 58, for example, due to an overload whereby the overload condition is directly sensed and accounted for by the aforementioned overload control means controlling the infeed drive means.

The infeed drive means 29,37,41 is schematically indicated in FIG. 1 wherein the feed line 23 and the return line 25 are seen to lead to the rear part 2 of the container 1. A hollow common carrier 26 therein has a first end 27 and a second end 28 which are respectively affixed such as by welding to the partitions 6 and 7 so that the common carrier 26 extends across the entire interior space of the container rear part 2. A pressure fluid operated drive motor 29 which is a first member of the infeed drive means 29,37,41, is fixedly mounted within the common carrier 26 at the first end 27 thereof. An input 30 of the drive motor 29 is connected to the feed line 23 and an output 31 of the drive motor 29 is connected to the return line 25.

Inside the hollow common carrier 26, an output shaft 32 of the drive motor 29 is drivingly connected to a transmission 33, a planetary gear in the illustrated exemplary embodiment, which is mounted at a flange plate 34. An output shaft 35 of the transmission 33 is keyed to a connector 36 of a shaft 37 on the opposite side of the flange plate 34. The drive shaft 37 represents a second member of the infeed drive means 29,37,41 and extends through the hollow common carrier 26 which is closed by a flange plate 38 at its second end 28. A protruding end of the drive shaft 37 is journalled in a bearing 39 and connected with a sprocket wheel 40 meshing with a common chain drive 41 which is a third member of the infeed drive means 29,37,41.

Figure 2:
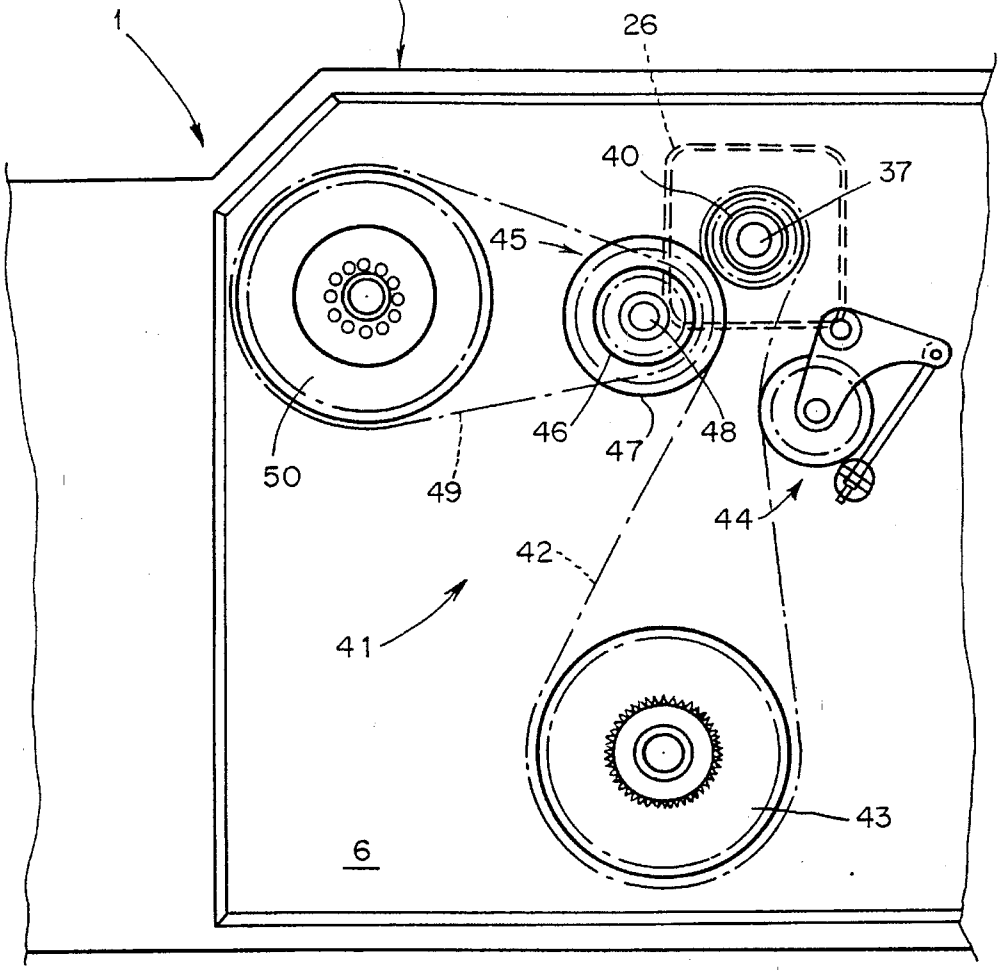
FIG. 2 is a schematic side view of one side wall of a container rear part housing the rotary impact mechanism and specifically shows a common chain drive of the infeed drive means in the comminuting machine as shown in FIG. 1.

FIG. 2 is a partial side view of the container rear part 2 from which the side wall 4 has been removed. There will be recognized the partition 6. On the outside of the partition 6, there is mounted a common chain drive 41 for driving the infeed means or apparatus to be described further hereinbelow. The common chain drive 41 essentially comprises two drive chains 42 and 49 which, however, are in common driving connection with the sprocket wheel 40 located at the second end 28 of the hollow common carrier 26 and driven by the pressure fluid operated drive motor 29 through the drive shaft 37. The sprocket wheel 40 is in mesh with a first drive chain 42 which is run around a sprocket wheel 43 and past a chain adjuster 44 of conventional construction which, therefore, requires no further description. The sprocket wheel 43 constitutes the drive wheel of the conveyor 66 of the later described infeed means 65. Furthermore, the drive chain 42 engages a reduction gear 45 containing a first sprocket wheel 46 and a second sprocket wheel 47 on a common shaft 48. A second drive chain 49 is passed around a sprocket wheel 50 which is associated with an intake roll 67 of the infeed means 65 to be described later.

Figure 3:
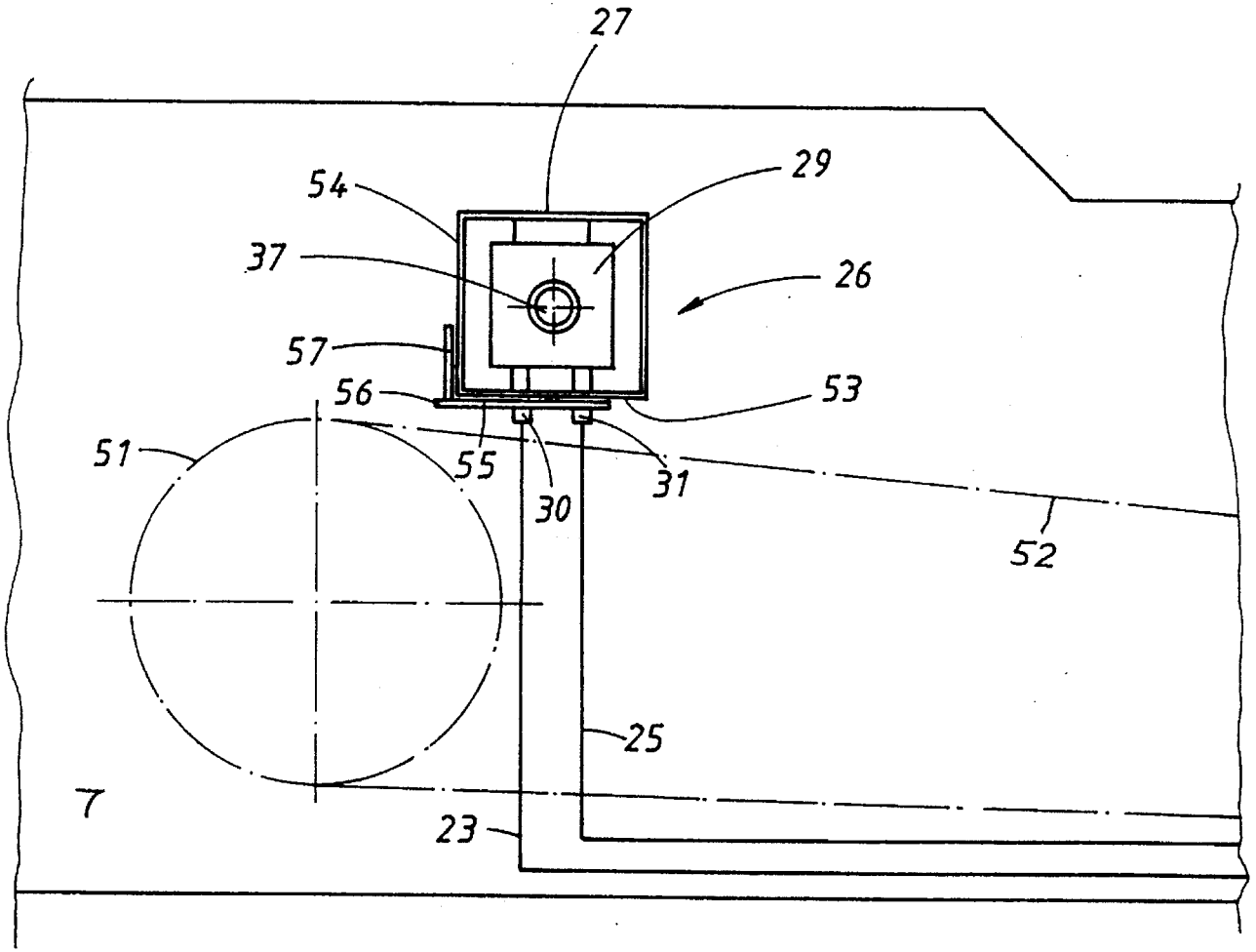
FIG. 3 is a schematic view of a side wall opposite the side wall of the container rear part as shown in FIG. 2.

FIG. 3 illustrates the opposite side of the container rear part 2 after removal of the side wall 4. There will be recognized the partition 7, the first end 27 of the hollow common carrier 26, and the pressure fluid operated drive motor 29 with its input 30 and the feed line 23 connected thereto and with its output 31 and the return line 25 connected thereto. Furthermore, there is shown a pulley or belt drive disk 51 and the associated drive belt 52 which originates from the transmission 18 in the front part 3 of the comminuting machine 1 and which preferably constitutes a strong, multiple V-belt for driving the rotary impact mechanism 58 to be described further hereinbelow.

The hollow common carrier 26, as illustrated, may have the form of a rectangular tube having two sides which face the rotary impact mechanism 58, see FIG. 4, but may assume any other suitable configuration for housing the pressure fluid operated drive motor 29 and the other purposes described hereinbelow. A first side 53 extends substantially parallel to the general infeed direction of the infeed means or apparatus 65 and a second side 54 extends substantially perpendicular thereto in an upward direction. The first side 53 carries an impact ledge 55 which is fastened thereat by releasable fastening means like, for example, a plurality of countersunk screws which pass through throughholes in the impact ledge 55 and engage threaded bores in the first side 53. The arrangement is such that a comminuting edge 56 of the impact ledge 55 protrudes beyond the first side 53 toward the rotary impact mechanism 58 in order to thereby define an entrance gap 83, see FIG. 4. In fact, the throughholes at the impact ledge 55 are arranged in two rows which extend in the lengthwise direction of the impact ledge 55 and which are transversely spaced from each other. As a result, the impact ledge 55 can be disengaged from the first side 53 in the event of excessive wear and turned around by 180° so that the opposite edge of the impact ledge 55 now protrudes beyond the first and second sides 53,54 to form the comminuting edge 56. The impact ledge 55 is made of high-strength, wear-resistant steel in order to ensure a sufficient useful service life. Furthermore, the comminuting edge 56 of the impact ledge 55 is supported by means of a support ledge 57 which is affixed to the second side 54 of the hollow common carrier 26 and bears upon the comminuting edge 56 on the side remote from the rotary impact mechanism 58.

FIG. 4 shows the container rear part 2 in a side view in which most of the side wall 4 and the partition 6 have been removed. The actual comminuting mechanism is accommodated by the housing or container rear part 2. This comminuting mechanism includes a rotary impact mechanism 58 which basically is, in the illustrated embodiment, of a construction similar to that of the mentioned Doppstadt AK 330 shredder. A drum 59 is equipped with flails 60 each of which is pivotably supported about a pivot axis 61. During revolution of the drum 59 in the rotational direction as indicated by the arrow 62, the flails 60 are subject to a centrifugal force and pivot outwardly in known manner. As a result, cutting members 63 of the flails 60 define a substantially cylindrical area 64 of action. The flails 60 are arranged in axial rows which are substantially transversely offset from each other in order to form a substantially uninterrupted cylindrical area 64 of action as in the aforementioned Doppstadt AK 330 shredder.

Infeed means or apparatus 65 are provided on an input side of the rotary impact mechanism 58 and include a suitable conveyor like a scraper conveyor 66 of known construction and a heavy-weight intake roll 67. The scraper conveyor 66 extends from a front end of the container to the rotary impact mechanism 58 and contains a plate 68 and two chains 69 of which only only one is visible in FIG. 4 and which extend lengthwise and laterally of the plate 68. The two chains 69 carry a multitude of scraping ledges 70 which extend across the plate 68. The chains 69 are in driving engagement with the sprocket wheel 43 shown in FIG. 2 and driven by the pressure fluid operated drive motor 29 through the drive shaft 37 and the first drive chain 42. In this manner the scraping ledges 70 act from below upon the material to be comminuted which is infed into the container, and pass the same to the rotary impact mechanism 58.

Figure 5:
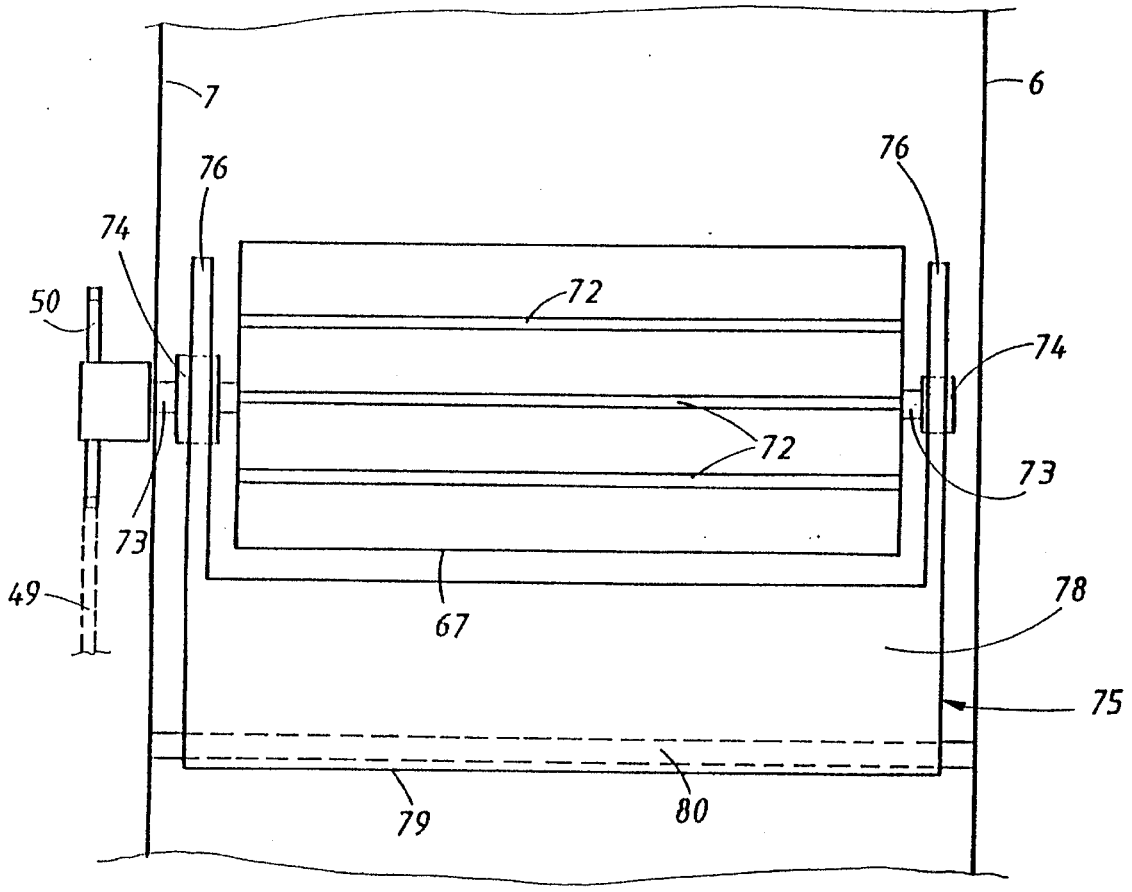
FIG. 5 is a schematic top plan view of the intake roll of the infeed means as shown in FIG. 4.

The intake roll 67, which is also shown in a top plan view in FIG. 5, contains a roll which is provided on its outside with gripping elements 71 for ensuring a gripping action on the top of the material infed into the container. In the illustrated exemplary embodiment, the gripping elements 67 are constituted by ledges or bars 72 which extend axially parallel to or lengthwise of the intake roll 67 and which are affixed such as by welding to the circumference of the intake roll 67. The gripping elements 71, however, may have any other configuration suitable for the indicated purpose. The ledges or bars 72 are disposed at substantially equal circumferential spacings around the circumference of the intake roll 67. Journals 73 of the intake roll 67 are provided at both end faces of the intake roll 67 and rotatably supported in the associated partitions 6 and 7 in respective bearings 74.

The bearings 74 are supported by a support structure 75 which includes respective bearing holders 76. The bearing holders 76 extend alongside the respective partitions 6 and 7. The bearing holders 76 and the respective partitions 6 and 7 contain aligned recesses of which only the recess 77 in the bearing holder 76 is visible in FIG. 4. The bearing holders 76 are interconnected across the container rear part 2 by means of a connecting member 78 which extends close to the intake roll 67 and prevents any material which is taken up by the intake roll 67, from becoming entrained by the intake roll 67. The connecting member 78 is provided with a tubular bearing 79 on the side remote from the intake roll 67. This tubular bearing 79 extends across the interior of the container rear part 2 between the partitions 6 and 7 and is pivotably supported at a shaft 80 which extends parallel to the tubular bearing 79 and which may be formed by the aforementioned shaft 48 rotatably supporting the reduction gear 45. Consequently, the intake roll 67 can pivot around the shaft 80 or 48, as the case may be, depending upon the filling height of the material infed into the container. The pivot angle around the shaft 80 or 48 is limited in the downward direction by stops 81 of which only one is visible in FIG. 4 and which are respectively secured to the partitions 6 and 7. The pivot angle around the shaft 80 or 48 is limited in the upward direction by projections 82 which project generally upwardly from the bearing holders 76 on the side remote from the intake roll 67 so as to abut the associated side of the hollow common carrier 26 in the uppermost position of the intake roll 67.

FIG. 4 also shows the hollow common carrier 26 with the impact ledge 55 and the protruding comminuting edge 56. It will be seen that the latter protrudes toward the area 64 of action as defined by the rotary impact mechanism 58. There is thus defined an entrance gap 83. The material infed into the container and conveyed to the rotary impact mechanism 58 by means of the scraper conveyor 66 and the intake roll 67 of the infeed means or apparatus 65 is taken up by the rotating flails 60 and thrown against the impact ledge 55 to be subjected to a first comminuting action. It should be noted in this context that the rotary impact mechanism 58 rotates at the comparatively high rotational speed of 1,000 rpm.

The material which is comminuted to an extent sufficient for passage through the entrance gap 83, then, is driven on by the rotating flails 60 and subjected to comminution by cooperation with an impact plate 84 disposed above the rotary impact mechanism 58. The impact plate 84 extends in an arcuate manner along a top portion of the rotary impact mechanism 58 to define a throughpass gap 85 which narrows in the rotational direction 62 of the rotary impact mechanism 58 or the rotating flails 60. Teeth 86 protrude from an inner side of the impact plate 84 in a direction opposing the rotational direction 62 of the rotary impact mechanism 58, namely in a manner such that the protruding height of the teeth 86 above the inner side of the impact plate 84 decreases in the rotational direction 62. The specific structure of the impact plate 84 is disclosed in detail in the second initially cross-referenced U.S. patent application by the applicant of the instant application and the disclosure of this copending application is incorporated herein by reference.

Like in the aforementioned cross-referenced U.S. patent application, the impact plate 84 is provided with a pivot bearing 87 at its front end facing the hollow common carrier 26. With its rear end, as viewed in the rotational direction 62 of the rotary impact mechanism 58, the impact plate 84 rests upon stops (not shown) located at the inner face of the partitions 6 and 7 of the container rear part 2. In this manner it will be ensured that non-disintegratable pieces of material like metallic articles or stones which are enabled to pass through the entrance gap 83 due to the pivotable mounting of the rotating flails 60, can not cause damage at the impact plate 84 because the impact plate 84 is pivotably raised in the presence of such non-disintegratable pieces and thus permits the same to pass through the throughpass gap 85.

The impact plate 84 precedes a discharge opening 87 at the container rear part 2; the comminuted material, then, is discharged through this discharge opening 87 under the action of the rotary impact mechanism 58. However, the discharge opening 87 may also be partially or entirely provided with or covered by further comminuting means 88 which are only schematically indicated in FIG. 4. Various constructions of such further comminuting means are disclosed in some of the initially cross-referenced U.S. patent applications and the disclosure thereof is incorporated herein by reference thereto. As also disclosed therein, the further comminuting means 88 may be linked to displacement means 89 disposed on an outer side of the impact plate 84 for pivoting between an operative position inside or closing the discharge opening 88 and an inoperative position indicated by broken lines in FIG. 4.

Still further, a cover plate covering the discharge opening 88 in the inoperative state of the comminuting machine 1 and pivotable into a supported, open position in the operative state of the commniuting machine 1, may also be linked to the rear end of the impact plate 84. This cover plate and its connection to the impact plate are also disclosed in some of the initially cross-referenced U.S. patent applications which are also incorporated herein by reference thereto.

While there are shown and described present preferred embodiments of the invention, it is to be distinctly understood that the invention is not limited thereto, but may be otherwise variously embodied and practiced within the the scope of the following claims.

What I claim is:

1. A comminuting machine comprising a housing for receiving material to be comminuted;

a rotary impact mechanism accommodated in said housing;

infeed means disposed in said housing and defining a general feed direction for feeding received material to said rotary impact mechanism;

said infeed means containing an impact ledge defining conjointly with said rotary impact mechanism an entrance gap providing a first comminuting action on infed material;

infeed drive means for driving said infeed means;

a common carrier accommodated in said housing for supporting at least part of said infeed drive means and said impact ledge;

said common carrier having a first side which faces said rotary impact mechanism, and a second side;

said first side of said common carrier extending substantially parallel to said general feed direction defined by said infeed means;

said impact ledge being releasably mounted at said first side of said common carrier;

said impact ledge having a protruding portion protruding from said first side toward said rotary impact mechanism in order to thereby define a comminuting edge; and said comminuting edge extending along substantially the entire common carrier and defining said entrance gap conjointly with said rotary impact mechanism.

2. The comminuting machine as defined in claim 1, wherein:

said housing has opposite sides; and said common carrier extends across said housing between said opposite sides.

3. The comminuting machine as defined in claim 2, wherein said common carrier is firmly secured to said opposite sides.

4. The comminuting machine as defined in claim 1, further including:

fastening means for releasably fastening said impact ledge at said first side of said common carrier; and said fastening means forming two rows of fastening means which extend parallel to each other along said impact ledge and at a transverse mutual spacing from each other.

5. The comminuting machine as defined in claim 1, wherein:

a support ledge is mounted at said second side of said common carrier;

said support ledge extending along substantially the entire length of said common carrier as well as toward said comminuting edge of said impact ledge; and said support ledge abutting said comminuting edge and thereby supporting the same.

6. The comminuting machine as defined in claim 1, wherein:

said comminuting machine constitutes a waste wood comminuting machine;

a container for receiving waste wood to be comminuted;

a wheel-supported support frame carrying said container and said drive means and defining a travel direction of said comminuting machine;

said container having a rear part with respect to said travel direction;

said rear part constituting said housing accommodating said rotary impact mechanism.

7. A comminuting machine comprising:

a housing for receiving material to be comminuted;

a rotary impact mechanism accommodated in said housing;

infeed means disposed in said housing and defining a general feed direction for feeding received material to said rotary impact mechanism;

said infeed means containing an impact ledge defining conjointly with said rotary impact mechanism an entrance gap providing a first comminuting action on infed material;

infeed drive means for driving said infeed means;

a common carrier accommodated in said housing for supporting at least part of said infeed drive means and said impact ledge; and said infeed drive means including a conveyor acting upon said received material from below and an intake roll acting on said received material from above.

8. The comminuting machine as defined in claim 7, wherein said impact ledge is made of high-strength wear-resistant steel.

9. The comminuting machine as defined in claim 7, further including:

a power unit comprising a prime mover and a pressure fluid pump drivingly connected to said prime mover;

said infeed drive means including a pressure fluid operated drive motor drivingly connected to said pressure fluid pump;

said common carrier constituting a hollow common carrier; and said pressure fluid operated drive motor being mounted inside said hollow common carrier.

10. The comminuting machine as defined in claim 9, further including:

drive means drivingly connecting said prime mover and said rotary impact mechanism;

an overload coupling drivingly interconnecting said drive means and said prime mover;

said pressure fluid pump being directly drivingly connected to said drive means driving said rotary impact mechanism; and overload control means operatively connected to said pressure fluid pump and said drive means for controlling said infeed drive means as a function of an overload occurring at said rotary impact mechanism.

11. The comminuting machine as defined in claim 9, wherein:

a drive shaft extending in said hollow common carrier from said pressure fluid operated drive motor;

said infeed drive means further containing a common chain drive for driving said conveyor and said intake roll; and said drive shaft drivingly interconnecting said pressure fluid operated drive motor and said common chain drive.

12. The comminuting machine as defined in claim 11, wherein:

said hollow common carrier has a first end and a second end associated with respective ones of said opposite sides of said housing;

said pressure fluid operated drive motor being mounted inside said hollow common carrier and being connected to said pressure fluid pump on one of said opposite sides outside of said housing; and said drive shaft extending through said hollow common carrier and being connected to said common chain drive on another one of said opposite sides outside of said housing.

13. The comminuting machine as defined in claim 11, wherein:

said common chain drive contains a sprocket wheel mounted at said drive shaft at an end remote from said pressure fluid operated drive motor and drivingly engaging a first chain leading to a sprocket wheel drivingly connected to said conveyor; and said common chain drive further contains a chain transmission drivingly engaged by said first chain and drivingly connected through a second chain to a sprocket wheel for driving said intake roll.

14. The comminuting machine as defined in claim 7, further including:

a support structure for pivotably supporting said intake roll across said housing;

said support structure comprising:

bearing holders for holding respective bearings rotatably journalling opposite ends of said intake roll;

a connecting member extending across said housing and interconnecting said bearing holders;

said connecting member having a pivot bearing on a side remote from said intake roll for pivotably supporting said support structure;

said bearing holders containing upwardly extending recesses permitting pivoting movement of said support structure and thereby said intake roll.

15. The comminuting machine as defined in claim 14, further including:

limiting stops for limiting an upward pivoting movement of said support structure and thereby the upward pivoting movement of said intake roll;

said limiting stops being provided at said bearing holders and abutting said common carrier in an upwardmost pivoted position of said bearing holders;

limiting stops for limiting a downward pivoting movement of said support structure and thereby the downward pivoting movement of said intake roll; and said limiting stops being provided at opposite sides of said housing and being abutted by said bearing holders in a downwardmost pivoted position of said bearing holders.

16. The comminuting machine as defined in claim 7, wherein said intake roll is provided with gripping elements on the outside thereof.

17. The comminuting machine as defined in claim 16, wherein:

said gripping elements constitute a plurality of ledges circumferentially mounted at the intake roll and extending along substantially the entire length of said intake roll; and said ledges being mounted at substantially equal circumferential spacings from each other.

18. The comminuting machine as defined in claim 7, wherein:

said comminuting machine constitutes a waste wood comminuting machine;

a container for receiving waste wood to be comminuted;

a wheel-supported support frame carrying said container and said drive means and defining a travel direction of said comminuting machine;

said container having a rear part with respect to said travel direction;

said rear part constituting said housing accommodating said rotary impact mechanism.

* * * * *